US006298207B1

(12) United States Patent
Slattery et al.

(10) Patent No.: US 6,298,207 B1
(45) Date of Patent: Oct. 2, 2001

(54) REPLENISHER MECHANISM FOR A DEVELOPMENT STATION OF A REPRODUCTION APPARATUS

(75) Inventors: Scott Thomas Slattery, Brockport; Jerry Eugene Livadas, Webster; James R. Carey, Rochester, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/574,036

(22) Filed: May 18, 2000

(51) Int. Cl.[7] ..... G03G 15/08
(52) U.S. Cl. ..... 399/258; 399/27; 399/261
(58) Field of Search ..... 399/258, 260, 399/261, 119, 120, 27; 222/161, DIG. 1

(56) References Cited

U.S. PATENT DOCUMENTS 4,418,643 * 12/1983 Barto, Jr. et al. ..... 399/261
4,692,017 * 9/1987 Maczuszenko et al. ..... 399/258 X
5,329,340 * 7/1994 Fukuchi et al. ..... 399/260 X

FOREIGN PATENT DOCUMENTS 03-063678 * 3/1991 (JP) .

* cited by examiner

*Primary Examiner*—Sophia S. Chen
(74) *Attorney, Agent, or Firm*—Lawrence P. Kessler

(57) ABSTRACT

A mechanism for replenishing particulate material from a receptacle to a remote reservoir. The replenisher mechanism includes a housing having a sensor for sensing the level of particulate material within the housing, pair of spaced end walls, and a pair of spaced side walls. At least a portion of the side walls are flexible. An interface provides flow communication of particulate material between a particulate material receptacle and the housing, and a delivery assembly provides flow communication of particulate material between the housing and a remote reservoir. At least one paddle assembly is operatively associated with at least one of the flexible side walls for moving such side wall in a manner to substantially prevent agglomeration and flake production in the particulate material within the housing. The paddle assembly includes a first pivot rod mounted in fixed spatial relation to the housing, a paddle supported on the first pivot rod, a second pivot rod carried by the paddle. A reciprocating actuator arm is connected to the second pivot rod to selectively move the paddle about the first pivot rod. A lever is pivotably mounted on the second pivot rod, whereby when the paddle is rotated about the first pivot rod by reciprocation of the actuator arm, the lever rotates about the second pivot rod providing movement of the flexible membrane adjacent to the first pivot rod causing the breaking of any particulate material bridges at that point.

18 Claims, 6 Drawing Sheets

REPLENISHER MECHANISM FOR A DEVELOPMENT STATION OF A REPRODUCTION APPARATUS

CROSS REFERENCE TO RELATED APPLICATIONS

Reference is made to the commonly assigned U.S. Patent Application, the respective disclosures of which being incorporated herein by reference:

U.S. application Ser. No. 09/574,055 filed on May 18, 2000, and entitled "REPLENISHER MECHANISM INTERFACE".

FIELD OF THE INVENTION

This invention relates in general to a replenisher mechanism for a development station of a reproduction apparatus, and more particularly to an electrographic reproduction apparatus development station where the replenisher mechanism for resupplying of marking particle material to a reproduction apparatus development station prevents agglomeration of the particulate material.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

Marking particle material is very cohesive which can readily agglomerate in hoppers to produce structures commonly referred to as stable ratholes and bridges. Such stable ratholes or bridges prevent uniform delivery of marking particles to the exit point from the hopper. This results in variations in concentration of the marking particles in the development station of the reproduction apparatus which can ultimately lead to image defects in the copies made by the reproduction apparatus. Marking particles also tends to stick to surfaces (even vertical surfaces) of the hopper making sensing the level of marking particles in the hopper difficult.

The marking particle material can form agglomerates or flakes through either cohesive or adhesive forces. Marking particle agglomerates formed cohesively are classified as hard or soft. Hard agglomerates cannot be broken up by the action of development station mixing, while soft agglomerates can be so broken up. On the other hand, marking particle flakes are pieces of melted or softened marking particles that have adhered together and hardened. Both the agglomerates and the flakes can be transferred to the dielectric support member of the reproduction apparatus and result in the formation of unwanted (undesirable) artifacts, or spots of marking particles, on copies made by the reproduction apparatus that render the copies unacceptable.

Current technology for preventing agglomeration of particulate material normally involves the use of a plastic or metal hopper with internal mechanical mixing elements such as stirring rods, oscillating bars, or rotating wire cages. These mixing elements serve to break up ratholes and bridges and also keep the marking particles moving towards the hopper exit. Additionally, the marking particle material hoppers generally include level sensors to monitor the level of particulate material in the hopper so as to determine when the material has to be replenished. Level sensors may include piezoelectric, capacitive, or inductive proximity sensors. The internal mechanical mixing elements and/or additional mechanical wipers are used to clear marking particles away from level sensors for accurate level reading. However, these internal mechanical mechanisms, whether being used to break up agglomerates or clear the level sensors, can in and of themselves cause flakes and agglomerates.

An alternative to internal mechanical mixing elements for preventing particulate material from agglomerating involves the use of flexible walls for the particulate material-containing hopper. Such flexible wall technology has been used in other industries before for feeding large amounts of cohesive materials. These flexible wall hoppers generally have a paddle on either side thereof. The paddles pivot from their midpoints to flex the flexible walls in order to break up the ratholes and bridges. The flexible wall hoppers in common commercial use now appear to rely on large paddle actuations to insure good particulate material flow. However, such paddle action is not suitable for use in marking particle material hoppers due to compression of the marking particles in the bottom part of the hopper. This would result in agglomerate and flake production. Moreover, if the paddle action were merely reduced so as to provide as little mechanical intervention as possible to reduce agglomerate and flake creation, this low level of actuation would fail to move the cohesive marking particles enough to completely break up bridging, in particular, at the pivot point of the paddle.

SUMMARY OF THE INVENTION

In view of the above, to solve this particulate material agglomeration problem, this invention is directed to an external device to actuate the flexible membrane of a flexible wall of a replenisher mechanism particulate material housing to substantially completely break up the bridging of marking particles in the housing. The replenisher mechanism includes a housing having a sensor for sensing the level of particulate material within the housing, pair of spaced end walls, and a pair of spaced side walls. At least a portion of the side walls are flexible. An interface provides flow communication of particulate material between a particulate material receptacle and the housing, and a delivery assembly provides flow communication of particulate material between the housing and a remote reservoir. At least one paddle assembly is operatively associated with at least one of the flexible side walls for moving such side wall in a manner to substantially prevent agglomeration and flake production in the particulate material within the housing. The paddle assembly includes a first pivot rod mounted in fixed spatial relation to the housing, a paddle supported on the first pivot rod, a second pivot rod carried by the paddle. A reciprocating actuator arm is connected to the second pivot rod to selectively move the paddle about the first pivot rod. A lever is pivotably mounted on the second pivot rod, whereby when the paddle is rotated about the first pivot rod by reciprocation of the actuator arm, the lever rotates about the second pivot rod providing movement of the flexible membrane adjacent to the first pivot rod causing the breaking of any particulate material bridges at that point.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 2:
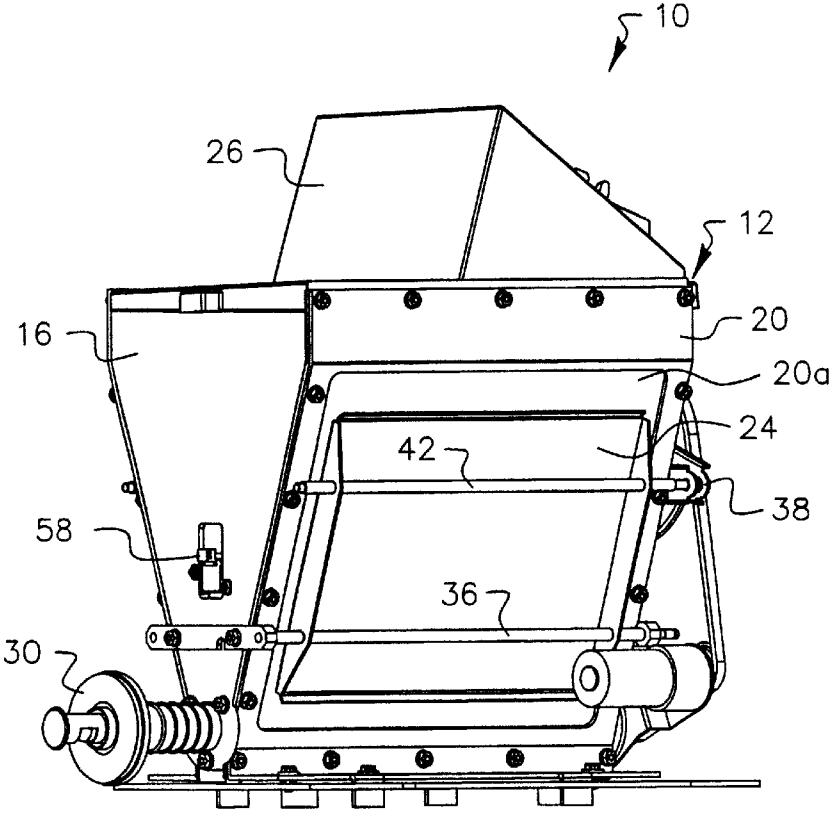
FIG. 2 is a view, in perspective, of the particulate material replenisher mechanism for a development station of a reproduction apparatus, of FIG. 1, viewed from the opposite side.
Figure 1:
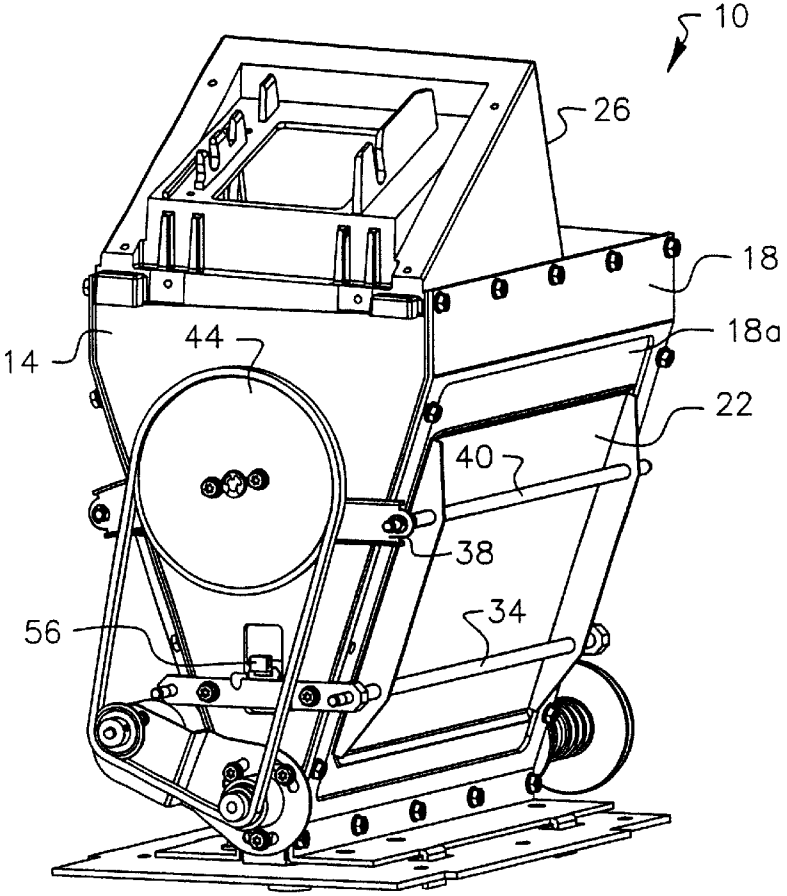
FIG. 1 is a view, in perspective, of the particulate material replenisher mechanism for a development station of a reproduction apparatus, according to this invention.
Figure 3:
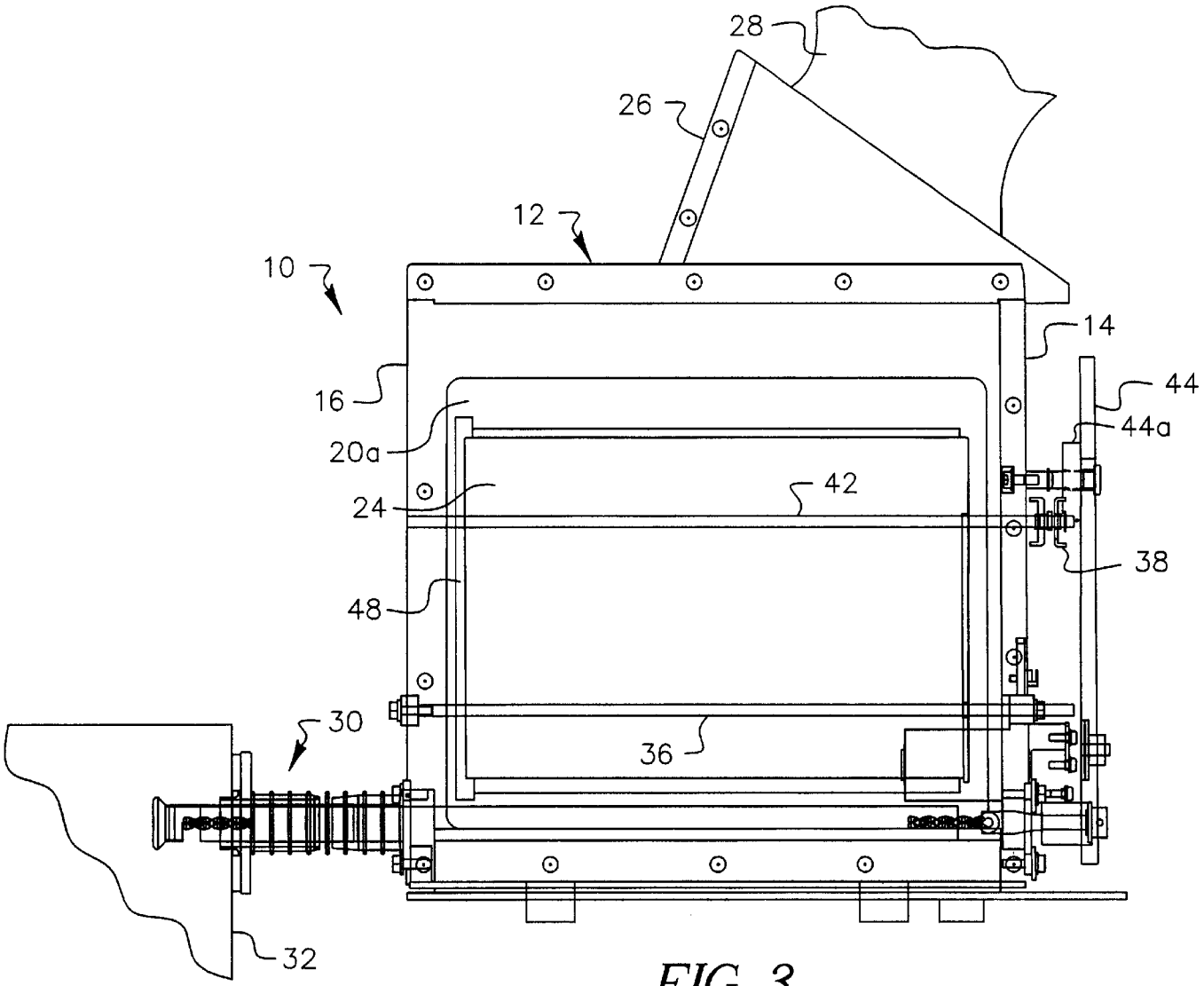
FIG. 3 is a side elevational view of the particulate material replenisher mechanism for a development station of a reproduction apparatus, of FIG. 1.

Referring now to the accompanying drawings, a particulate material replenisher mechanism, according to this invention, is best shown in FIGS. 1–3, and designated generally by the numeral 10. The replenisher mechanism 10 includes a particulate material housing 12. The housing 12 has a pair of end walls 14, 16 spaced substantially parallel to one another. Connected to, and extending between, the end walls l4, 16 are side walls 18, 20. The side walls 18, 20 are spaced from one another so as to be further apart at the top of the side walls and closer together at the bottom of the side walls.

The replenisher mechanism 10 has an interface 26 mounted on the top of the housing 12 thereof. The interface 26 provides for connection to a particulate material receptacle 28 to enable selective flow communication for the particulate material between the receptacle and the housing 12 of the replenisher mechanism. The interface 26 has an angled entrance associated with the particulate material receptacle 28 to allow the particulate material to flow out of the receptacle reliably. Without this angled mounting, particulate material would most likely flow out of the receptacle very slowly and may form a bridge, thereby stopping particle flow all together. Further, the housing 12 includes a particulate material delivery assembly 30 to provide selective flow communication for the particulate material between the housing 12 and a remote reservoir 32 (see FIG. 3), such as a development station of a typical electrographic reproduction apparatus (not shown). The delivery assembly 30 will be described more fully hereinbelow.

According to this invention, the replenisher mechanism 10 utilizes flexible membranes on the angled sides of the particulate material housing 12, the membranes being alternately compressed with paddles which pivot from a point near their respective bottoms to push against the particulate material inside the housing. The moving particles act to fill in ratholes and collapse bridges that are formed during material delivery. The paddles are moved in tandem such that the particulate material is never being compressed between the paddles. This tandem actuation of the flexible membranes by two paddles provide movement of the particulate material inside the housing without mechanical intervention inside the housing, thus reducing the propensity of the particles to form agglomerates and flakes while insuring that material bridges and ratholes do not form.

Particularly, a substantial portion of each of the side walls 18, 20 is respectively formed of a flexible membrane 18*a*, 20*a*. The important aspect of the formulation of the material of the flexible membrane is that it does not chemically (or otherwise) interact with the particulate material in the housing to negatively effect the particulate material or cause deterioration of the flexible membrane itself. In the preferred embodiment the particulate material is polymer marking particles for developing electrostatic images in a reproduction apparatus. Accordingly, the material of the flexible membranes is made, for example, from silicon rubber that is known to be safe to use with electrostatic image development polymer marking particles.

The flexible membranes 18*a*, 20*a* are periodically gently flexed respectively by paddles 22, 24. The flexible membranes are active across the whole length of the housing side walls 18, 20 allowing actuation even at the corners of the end walls 14, 16. As will be more fully explained, the paddles 22, 24 are moved in tandem so that marking particle material in the housing 12 is never squeezed between the flexible membranes. This decreases the probability of formation of marking particle agglomerates. The paddles 22, 24 are respectively supported on pivot rods 34, 36. The pivot rods 34, 36 are, in turn, mounted in fixed spatial relation to the housing 12 of the replenisher mechanism 10. An actuator arm 38 is connected to pivot rods 40, 42 respectively associated with the paddles 22, 24. The arm 38 is reciprocated in any well known manner, by for example a cam 44*a* mounted on a drive sprocket 44. As the arm reciprocates, the paddles 22, 24 move in tandem such that when one paddle is moving in a direction to flex the associated membrane in toward the housing 12, the other paddle is moving in a direction to enable the associated membrane to flex away from the housing.

Figure 5:
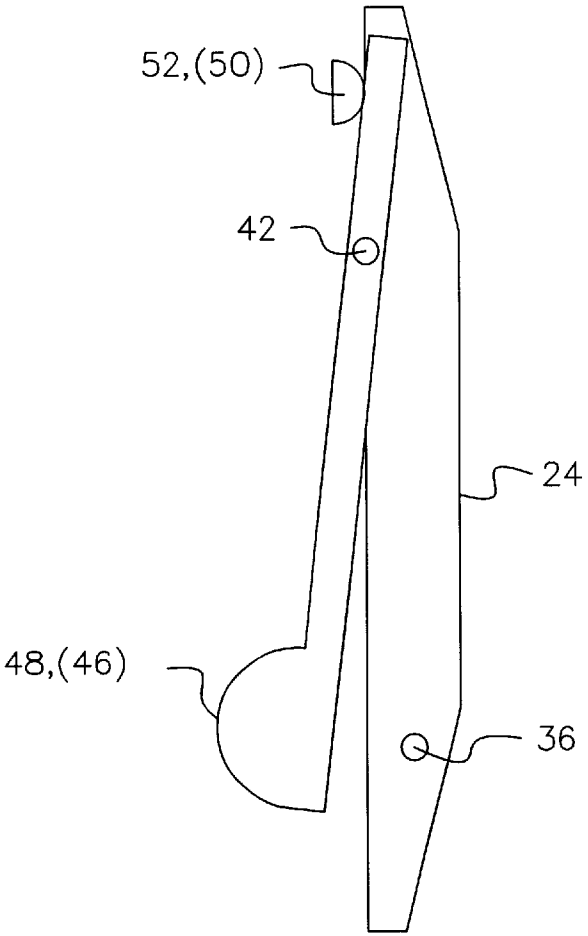
FIG. 5 is a side elevational view, on an enlarged scale, of the an external paddle for the particulate material replenisher mechanism, shown in the post-actuation state.
Figure 4:
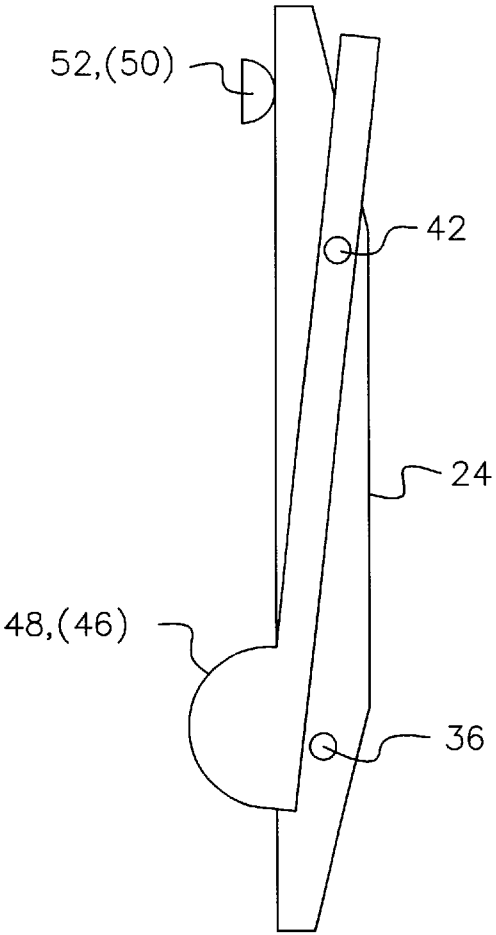
FIG. 4 is a side elevational view, on an enlarged scale, of the an external paddle for the particulate material replenisher mechanism, shown in the pre-actuation state.

As shown in FIGS. 4 and 5, the paddles 22, 24 are rotated around the respective pivot rods 34, 36 to produce sufficient translation at the uppermost point of the paddles for breaking particulate material bridges throughout the housing (in the preferred embodiment approximately 6 mm), except opposite the paddle pivot rods. There is in effect no movement of the flexible membranes at those points. Therefore, the replenisher mechanism 12 further includes levers 46, 48 to insure that particulate material cannot form a bridge near the pivot rods 34, 36 of the paddles. The levers 46, 48 are respectively pivotably mounted on the pivot rods 40, 42. When the paddles 22, 24 are rotated about the respective pivot rods 34, 36 by reciprocation of the actuator arm 38, the levers also rotate (about pivot rods 42, 44, until they respectively strike the lever stops 50 52. The paddles continue rotation, but the levers begin to rotate around the pivot rods 42, 44, thus providing movement of the associated flexible membranes adjacent to the paddle pivot rods 34, 36. This causes breaking of any particulate material bridges at that point.

Figure 9:
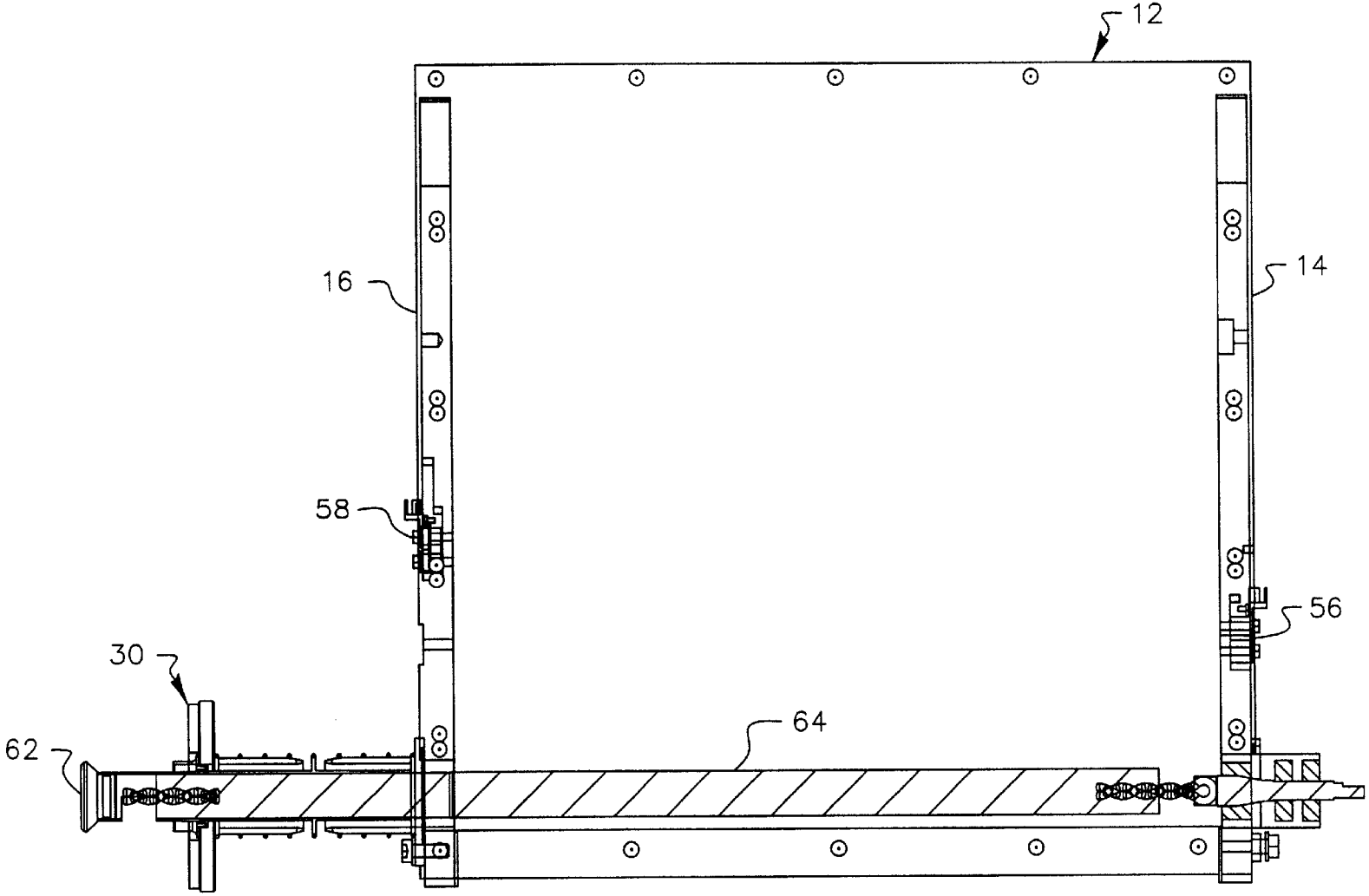
FIG. 9 is a side elevational view, in cross-section and on an enlarged scale, of the particulate material replenisher mechanism hopper, showing the location of the level sensors and the exit feed auger.

Further, according to this invention, sensing of the level of particulate material in the housing 12 of the replenisher mechanism 10 is accomplished by providing a plurality of level sensors 56, 58 (see FIGS. 1, 2, and 9). The level sensors 56, 58 are used to indicate when to add particulate material to the housing 12. This is important aspect of this invention in that the housing may hold over two receptacles of particulate material, and if material is added too soon an overflow may result. The level sensors 56, 58 are, for example, of the piezoelectric type with the sensing surface being a flat diaphragm. The level sensors 56, 58 are respectively located on the end wall 14, 16 of the housing 12. Each sensor is at a different elevation. The sensors must also be mounted flush or slightly protruded from the end walls so as not to allow a gap that material can become trapped in thus giving false indication of particulate material level.

Figure 6:
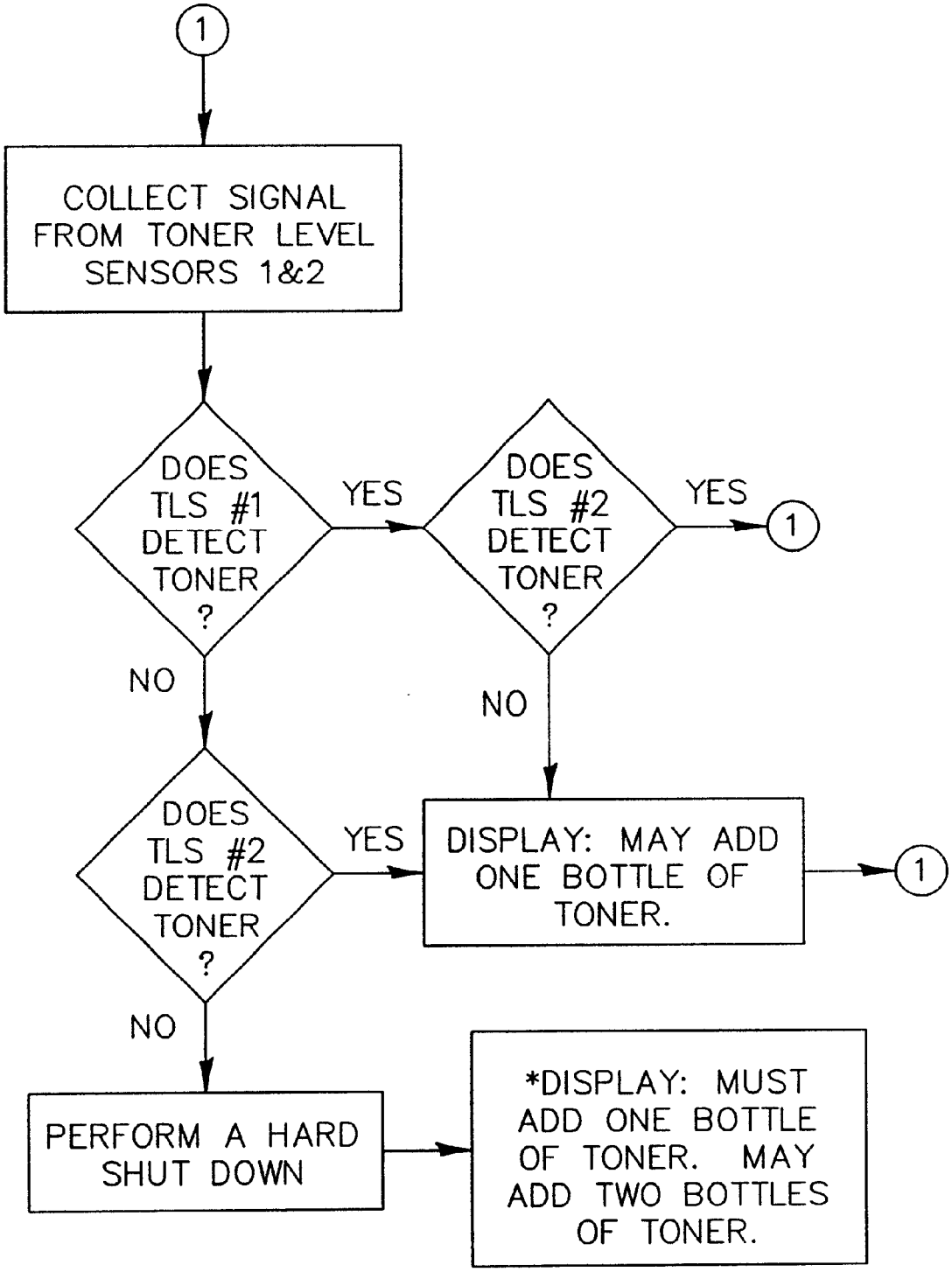
FIG. 6 is a logic flow diagram for the addition of particulate material to the replenisher mechanism.

Multiple level sensors are used to give the a more accurate picture of how much particulate material is left in the housing of the replenisher mechanism 10. As such, when the first (higher) of the sensors (for example, sensor 58 on the end wall 16) changes state to indicate that there is no particulate material in front of it, a signal may be generated indicating that one receptacle of particulate material may be supplied to the housing 12. Further, when the second (lower) of the sensors (for example, sensor 56 on the end wall 14) changes state to indicate that there is no particulate material in front of it, a signal may be generated indicating that more than one receptacle of particulate material may be supplied to the housing 12. A logic flowchart for this dual mode of sensing of particulate material level is shown in FIG. 6. As described, the replenisher mechanism 10, including two incorporating moveable membrane to gently agitate the bulk of marking particles in the hopper with the help of two paddles, negates the tendency of particulate material to form bridges and ratholes. Furthermore, it keeps the bulk of the material moving across the face of the level sensors, without the need for additional internal mechanical mechanisms, such as wipers or agitators, to keep the level sensors cleaned, insuring that the sensors are able to properly sense the presence of marking particles.

Figure 7:
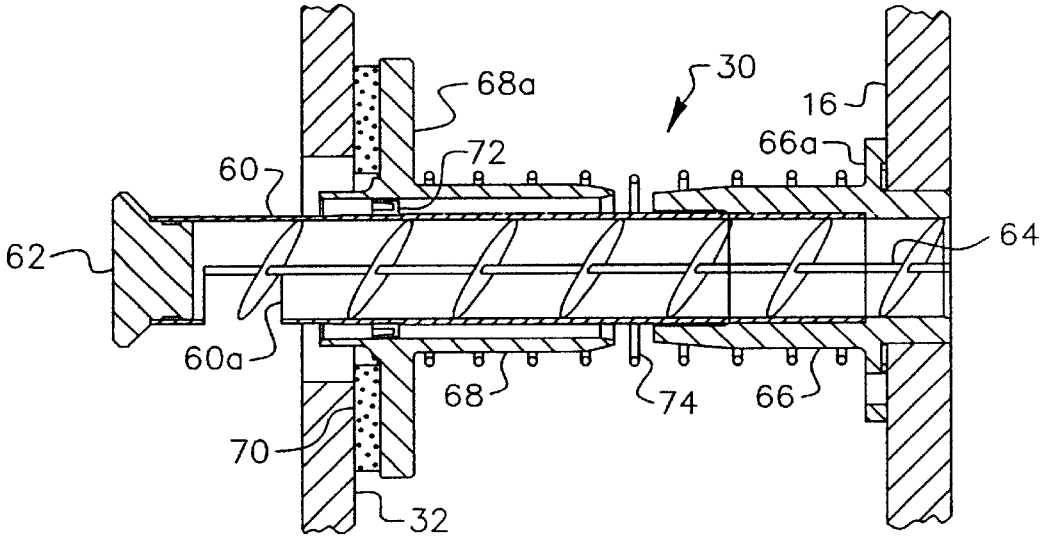
FIG. 7 is a side elevational view, in cross-section and on an enlarged scale, of the shut off assembly for the particulate material replenisher mechanism, shown in its open position.
Figure 8:
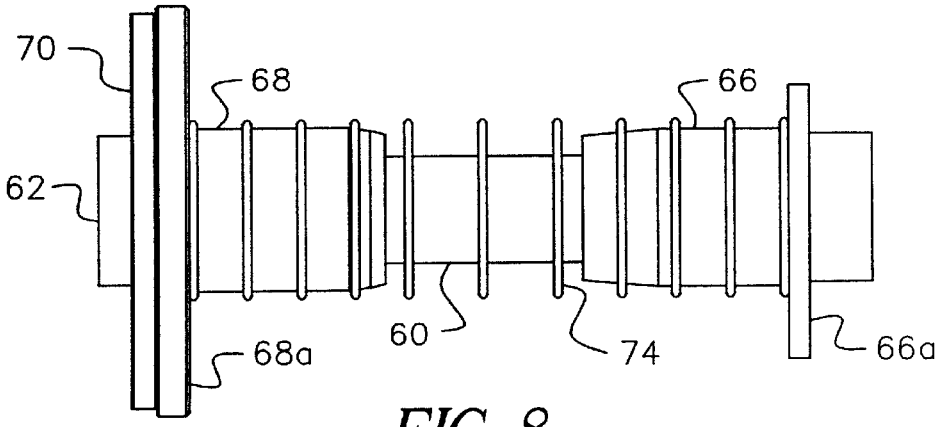
FIG. 8 is a side elevational view, on an enlarged scale, of the shut off assembly for the particulate material replenisher mechanism, shown in its closed position.

The particulate material delivery assembly 30 of the replenisher mechanism 10 is best shown in FIGS. 7–9. The delivery assembly 30 includes a delivery tube 60 sealed at one end by a cap 62, and having an opening 60*a* adjacent to the end cap 62. The delivery tube 60 is adapted to accommodate a feed screw 64, which in operation advances particulate material from the housing 12 into the reservoir 32 through the tube. The delivery tube 60 supports an adapter member 66 and a slider member 68. The adapter member 66 has a flange 66*a* which is attached to the end wall 16 to properly locate the delivery tube 60 with respect to the feed screw 64. The slider member 68 has a flange 68*a* including a face seal 70. The slider member 68 has an internal diameter larger than the external diameter of the delivery tub 60 such that the slider member is free to slide on the delivery tube and move to accommodate any offset between the longitudinal axes of the delivery tube and the slider member. A seal 72 prevents particulate material leakage between the delivery tube 60 and the slider member 68. A compression spring 74 is located between the flanges 66*a* and 68*a* to urge the slider into engagement with the end cap 62 (see FIG. 8).

In the operation of the delivery assembly 30, when the reservoir 32 (of the development station) and the replenisher mechanism 10 are not installed in operative association (e.g., the development station or the replenisher is removed from the reproduction apparatus), the slider member 68 is positively urged into engagement with the end cap 62 by the compression spring 74. As such, the delivery tube 60 is sealed so that particulate material cannot leak out of the replenisher housing. However, when the reservoir 32 and the replenisher mechanism 10 are installed in operative association, the slider member 68 is urged by contact of the face seal 70 of the flange 68*a* with the reservoir 32, in a direction to uncover the opening 60*a*. This will provide particulate material flow communication via the delivery tube between the replenisher mechanism housing 12 and the reservoir 32. As noted above, the relationship between the slider member 68 and the delivery tube 60 is such that any angular misalignment between the reservoir 32 of the development station and the replenisher mechanism 10 can be accommodated. Further, the delivery assembly 30 enables removal of the reservoir without moving the replenisher mechanism and insures that particulate material will not escape from the replenisher mechanism when the reservoir is removed.

In an alternate embodiment of the flexible wall housing of the replenisher mechanism 10, the flexible membranes and housing may be replaced by a flexible, v-shaped particulate material-containing bottle. The paddle actuation would then be applied to the bottle directly. This would require a small reservoir of particulate material to be kept below the bottle in a U-shaped channel which holds the material delivery auger to allow for bottle changes without interruption of particle delivery.

The invention has been described in detail with particular reference to certain preferred embodiments thereof, but it will be understood that variations and modifications can be effected within the spirit and scope of the invention.

What is claimed is:

1. A mechanism for replenishing particulate material from a particulate material receptacle to a remote reservoir, said replenisher mechanism comprising:

a housing having a sensor for sensing a level of particulate material within said housing, a pair of spaced end walls, and a pair of spaced side walls, at least a portion of said side walls being flexible;

an interface providing flow communication of particulate material between said particulate material receptacle and said housing;

a delivery assembly providing flow communication of particulate material between said housing and said remote reservoir; and at least one agglomerate preventing assembly operatively associated with at least one of said flexible portions of said side walls for moving such at least one flexible portion in a manner to substantially prevent agglomeration and flake production in the particulate material within said housing, said assembly including a first pivot rod mounted in fixed spatial relation to the housing, a paddle supported on said first pivot rod, a second pivot rod carried by said paddle, a reciprocating actuator arm connected to said second pivot rod to selectively move said paddle about said first pivot rod, a lever pivotably mounted on said second pivot rod, whereby when said paddle is rotated about said first pivot rod by reciprocation of said actuator arm, said lever rotates about said second pivot rod providing movement of said at least one flexible portions of said side walls adjacent to said first pivot rod causing breaking of any particulate material bridges at that point.

2. The replenisher mechanism according to claim 1 wherein said end walls are spaced substantially parallel to one another, and said side walls are spaced from one another so as to be further apart at the top of said side walls and closer together at the bottom of said side walls.

3. The replenisher mechanism according to claim 2 wherein said flexible portions of said side walls are formed of a material which does not interact with the particulate material in said housing.

4. The replenisher mechanism according to claim 1 wherein there are a plurality of agglomerate preventing assemblies, and said flexible portions of each of said side walls has respective one of said agglomerate preventing assemblies operatively associated therewith.

5. The replenisher mechanism according to claim 4 wherein said plurality of actuator arms are connected to said second pivot rods of each of said paddles respectively so as to move said paddles in tandem such that when one paddle is moving in a direction to flex the associated side wall flexible portion toward said housing, the other paddle is moving in a direction to enable the associated side wall flexible portion to flex away from said housing.

6. The replenisher mechanism according to claim 5 wherein each of said actuator arms is reciprocated by a cam mounted on a drive sprocket.

7. The replenisher mechanism according to claim 1 wherein said delivery assembly includes a delivery tube having an opening adjacent to one end, an end by a cap for sealing said one end of said delivery tube, said delivery tube being adapted to accommodate a feed screw for advancing particulate material from said housing into said remote reservoir.

8. The replenisher mechanism according to claim 7 wherein said delivery assembly further includes an adapter member supported on said delivery tube, said adapter member having a flange which is attached to an end wall of said housing to properly locate said delivery tube with respect to the feed screw, a slider member supported on said delivery tube, said slider member having a flange including a face seal, said slider member having an internal diameter larger than an external diameter of said delivery tube such that said slider member is free to slide on said delivery tube and move to accommodate any offset between respective longitudinal axes of said delivery tube and said slider member, a seal mounted on said delivery tube for preventing particulate material leakage between said delivery tube and said slider member, and a compression spring located between said flanges of said adapter member and said slider member to urge said slider member into engagement with said end cap.

9. The replenisher mechanism according to claim 1 wherein said level sensor includes a plurality of level sensors respectively located on said end walls of said housing, said sensors are respectively at a different elevation, whereby when a first (higher) of said sensors changes state to indicate that there is no particulate material in front of it, a signal may be generated indicating that one receptacle of particulate material may be supplied to said housing, and when a second (lower) of the sensors changes state to indicate that there is no particulate material in front of it, a signal may be generated indicating that more than one receptacle of particulate material may be supplied to the housing.

10. The replenisher mechanism according to claim 9 wherein each of said level sensors is a piezoelectric type sensor with a sensing surface including a flat diaphragm mounted flush or slightly protruded from said end walls so as not to allow a gap that material can become trapped in thus giving false indication of particulate material level.

11. In a reproduction apparatus, a mechanism for replenishing marking particle material from a marking particle receptacle to a remote developer station reservoir, said replenisher mechanism comprising:

a housing having a sensor for sensing a level of particulate material within said housing, a pair of spaced end walls, and a pair of spaced side walls, at least a portion of said side walls being flexible;

an interface providing flow communication of marking particle material between said marking particle receptacle and said housing;

a delivery assembly providing flow communication of marking particle material between said housing and said remote developer station reservoir; and a pair of paddle assemblies operatively associated with said flexible portions of said side walls respectively for moving such flexible portions in a manner to substantially prevent agglomeration and flake production in the particulate material within said housing, said paddle assemblies respectively including a first pivot rod mounted in fixed spatial relation to the housing, a paddle supported on said first pivot rod, a second pivot rod carried by said paddle, a reciprocating actuator arm connected to said second pivot rod to selectively move said paddle about said first pivot rod, a lever pivotably mounted on said second pivot rod, whereby when said paddle is rotated about said first pivot rod by reciprocation of said actuator arm, said lever rotates about said second pivot rod providing movement of said flexible portion of said side wall adjacent to said first pivot rod causing breaking of any particulate material bridges at that point.

12. The replenisher mechanism according to claim 11 wherein said end walls are spaced substantially parallel to one another, and said side walls are spaced from one another so as to be further apart at the top of said side walls and closer together at the bottom of said side walls.

13. The replenisher mechanism according to claim 12 wherein said flexible portions of said side walls are formed of a material which does not interact with the particulate material in said housing.

14. The replenisher mechanism according to claim 13 wherein said plurality of actuator arms are connected to said second pivot rods of each of said paddles respectively, said actuator arms being reciprocated, by a cam mounted on a drive sprocket, so as to move said paddles in tandem such that when one paddle is moving in a direction to flex the associated side wall flexible portion toward said housing, the other paddle is moving in a direction to enable the associated side wall flexible portion to flex away from said housing.

15. The replenisher mechanism according to claim 11 wherein said delivery assembly includes a delivery tube having an opening adjacent to one end, an end by a cap for sealing said one end of said delivery tube, said delivery tube being adapted to accommodate a feed screw for advancing particulate material from said housing into said remote developer station reservoir.

16. The replenisher mechanism according to claim 15 wherein said delivery assembly further includes an adapter member supported on said delivery tube, said adapter member having a flange which is attached to an end wall of said housing to properly locate said delivery tube with respect to the feed screw, a slider member supported on said delivery tube, said slider member having a flange including a face seal, said slider member having an internal diameter larger than an external diameter of said delivery tub such that said slider member is free to slide on said delivery tube and move to accommodate any offset between respective longitudinal axes of said delivery tube and said slider member, a seal mounted on said delivery tube for preventing particulate material leakage between said delivery tube and said slider member, and a compression spring located between said flanges of said adapter member and said slider member to urge said slider member into engagement with said end cap.

17. The replenisher mechanism according to claim 11 wherein said level sensor includes a plurality of level sensors respectively located on said end walls of said housing, said sensors are respectively at a different elevation, whereby when a first (higher) of said sensors changes state to indicate that there is no particulate material in front of it, a signal may be generated indicating that one receptacle of particulate material may be supplied to said housing, and when a second (lower) of the sensors changes state to indicate that there is no particulate material in front of it, a signal may be generated indicating that more than one receptacle of particulate material may be supplied to the housing.

18. The replenisher mechanism according to claim 17 wherein each of said level sensors is a piezoelectric type sensor with a sensing surface including a flat diaphragm mounted flush or slightly protruded from said end walls so as not to allow a gap that material can become trapped in thus giving false indication of particulate material level.

* * * * *